US008015644B2

(12) United States Patent
Lee et al.

(10) Patent No.: US 8,015,644 B2
(45) Date of Patent: Sep. 13, 2011

(54) METHOD FOR CONTROLLING WASHING MACHINE

(75) Inventors: Youn Dong Lee, Changwon-si (KR); In Geun Ahn, Changwon-si (KR)

(73) Assignee: LG Electronics Inc., Seoul (KR)

( * ) Notice: Subject to any disclaimer, the term of this patent is extended or adjusted under 35 U.S.C. 154(b) by 443 days.

(21) Appl. No.: 11/628,508

(22) PCT Filed: Jan. 25, 2006

(86) PCT No.: PCT/KR2006/000284

§ 371 (c)(1),
(2), (4) Date: Jan. 18, 2008

(87) PCT Pub. No.: WO2006/101304

PCT Pub. Date: Sep. 28, 2006

(65) Prior Publication Data

US 2008/0201865 A1 Aug. 28, 2008

(30) Foreign Application Priority Data

Mar. 25, 2005 (KR) ..... 10-2005-0025057
Jan. 6, 2006 (KR) ..... 10-2006-0002009

(51) Int. Cl.
*D06B 19/00* (2006.01)

(52) U.S. Cl. ..... 8/149.3

(58) Field of Classification Search ..... 8/159, 149.3
See application file for complete search history.

(56) References Cited

U.S. PATENT DOCUMENTS

| | | | | |
|---|---|---|---|---|
| 5,520,025 | A * | 5/1996 | Joo et al. | 68/12.05 |
| 6,691,536 | B2 * | 2/2004 | Severns et al. | 68/12.27 |
| 2004/0255391 | A1 | 12/2004 | Kim et al. | |

FOREIGN PATENT DOCUMENTS

| | | | |
|---|---|---|---|
| CN | 1534130 | | 10/2004 |
| CN | 1537995 | | 10/2004 |
| CN | 1580371 | | 2/2005 |
| DE | 19743508 | A1 | 4/1999 |
| EP | 1469120 | A1 | 10/2004 |
| EP | 1 544 345 | | 6/2005 |
| KR | 10-2004-0088884 | | 10/2004 |
| KR | 10-2005-0017489 | | 2/2005 |
| KR | 10-2005-0060566 | A | 6/2005 |
| KR | 10-2006-0036754 | | 5/2006 |
| KR | 10-2006-0100605 | | 9/2006 |

* cited by examiner

*Primary Examiner* — Michael Barr
*Assistant Examiner* — Charles W Kling
(74) *Attorney, Agent, or Firm* — McKenna Long & Aldridge LLP

(57) ABSTRACT

A method for controlling a washing machine is disclosed. The method for controlling a washing machine having a steam generator includes a step of automatically discharging water of the steam generator outside of the steam generator during the operation of the washing machine. Therefore, according to the present invention, foreign substances may be efficiently prevented from precipitating in the steam generator.

27 Claims, 8 Drawing Sheets

[Fig. 1]
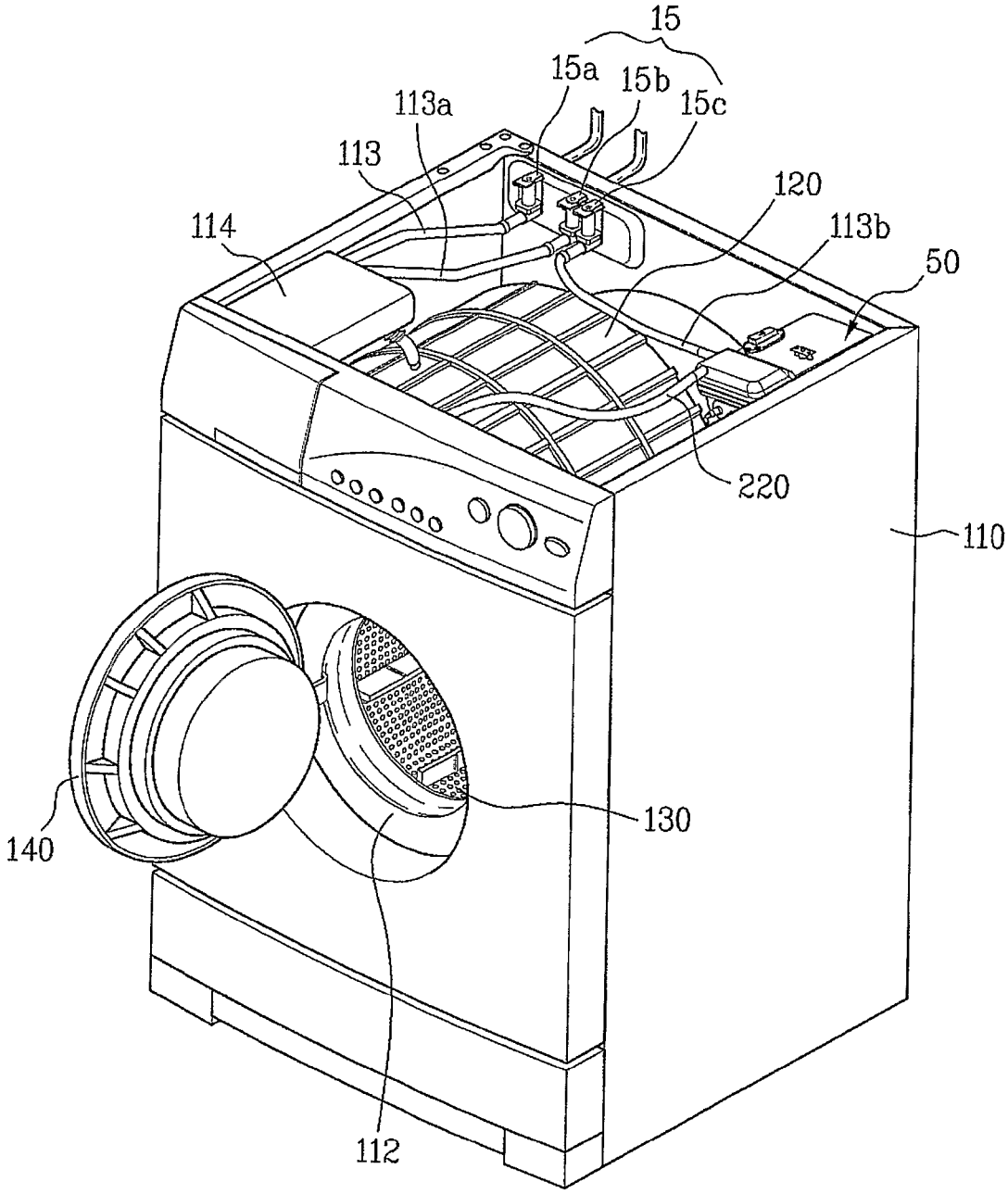

[Fig. 2]
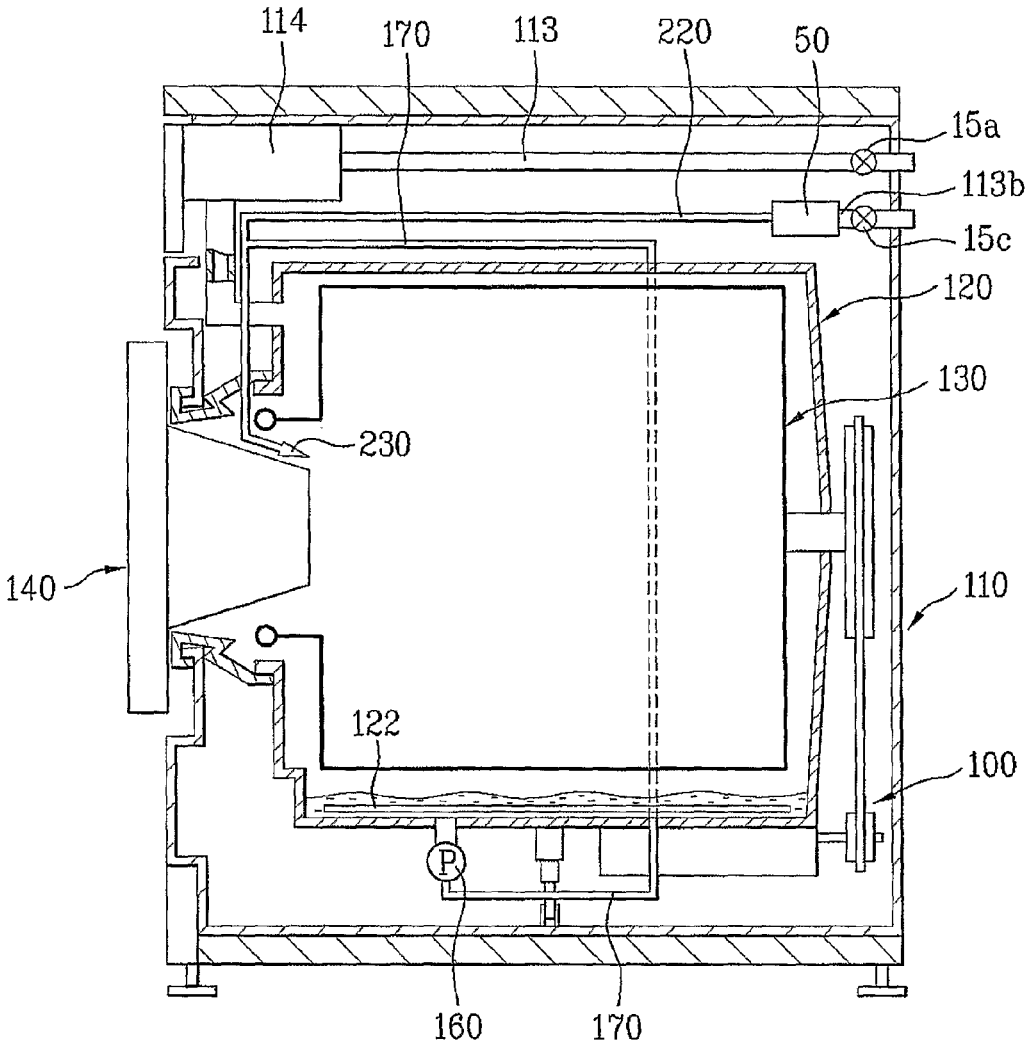

[Fig. 3]
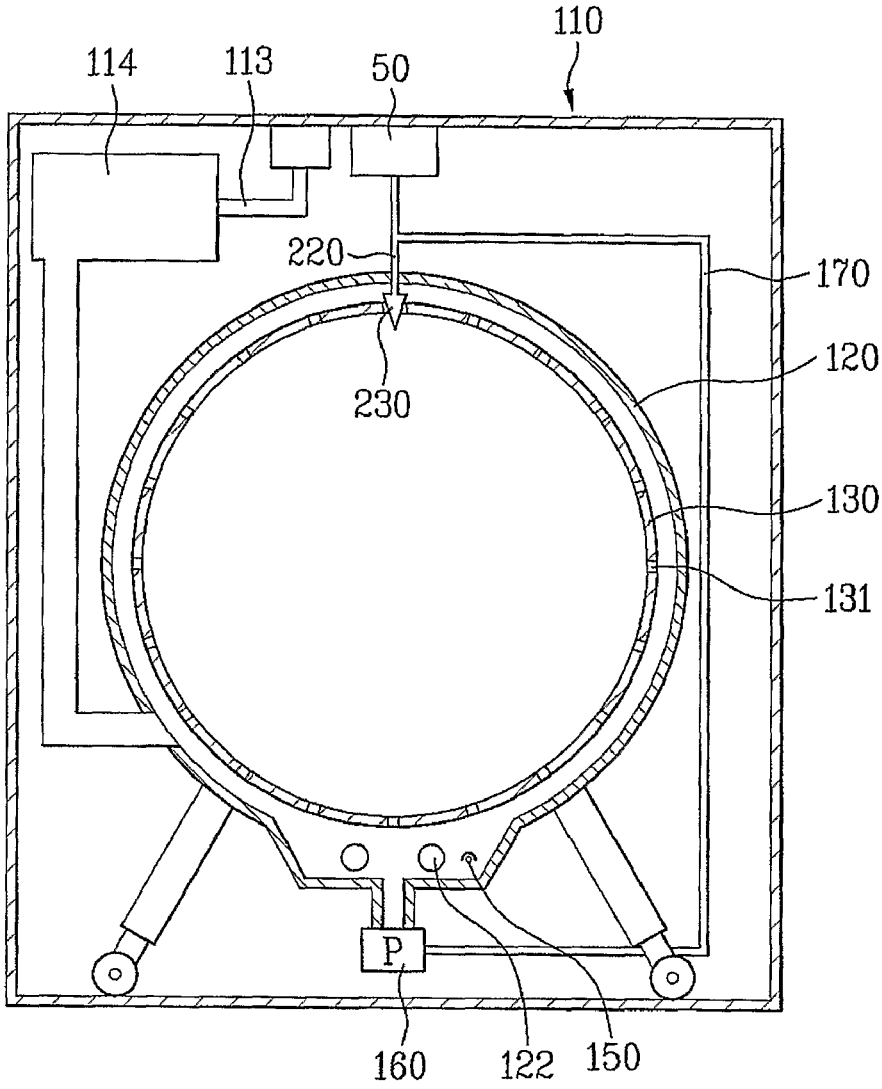

[Fig. 4]
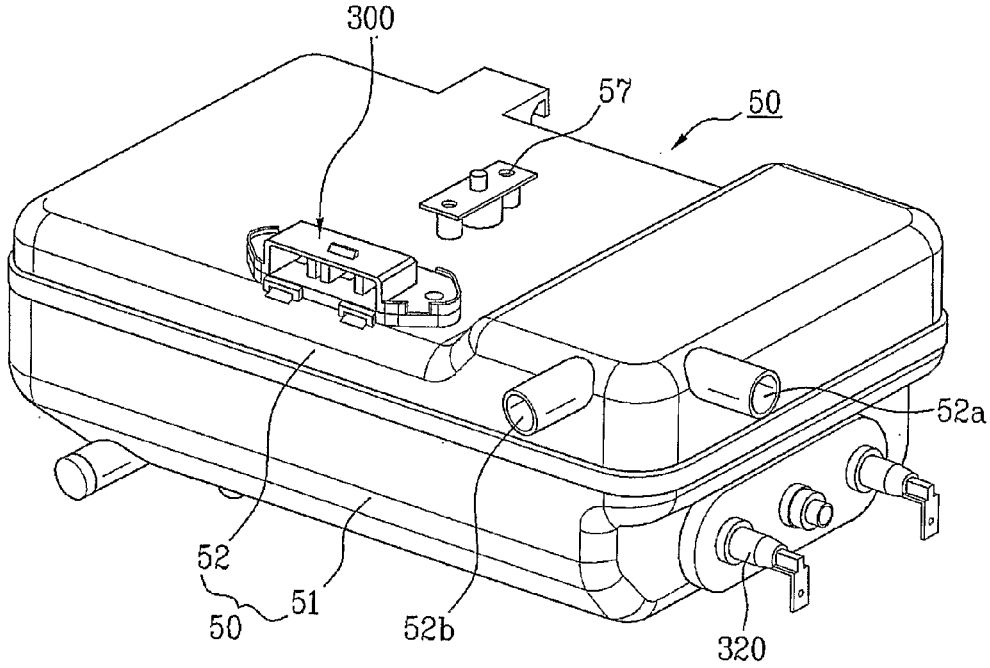
[Fig. 5]
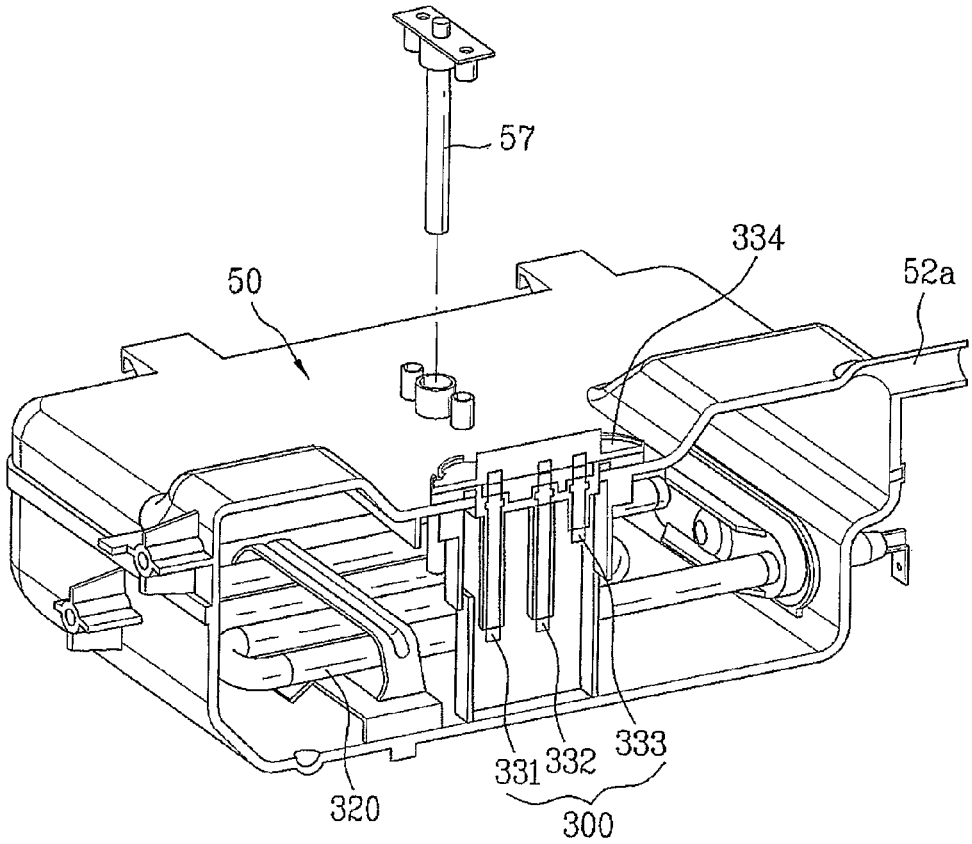

[Fig. 6]
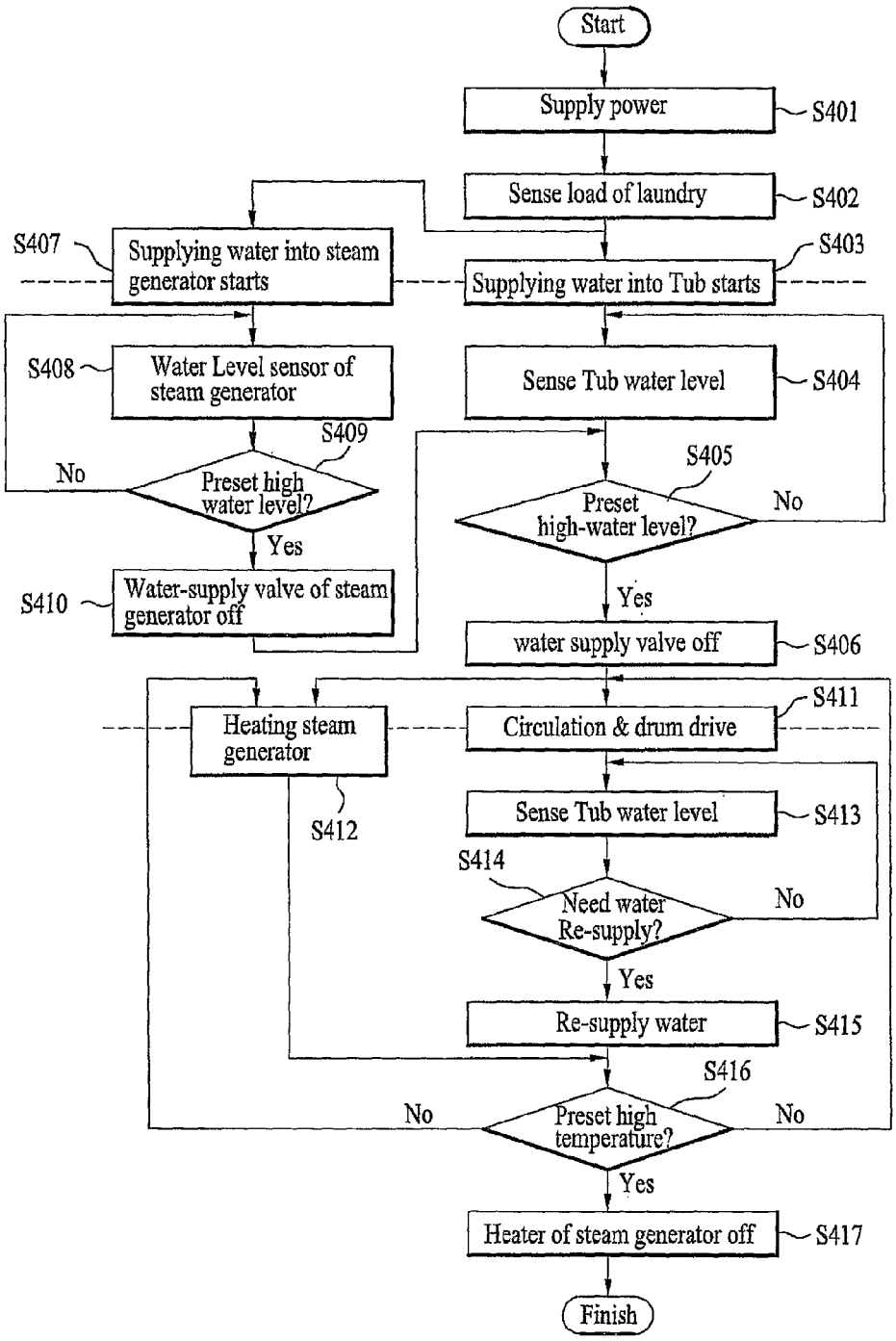

[Fig. 7]
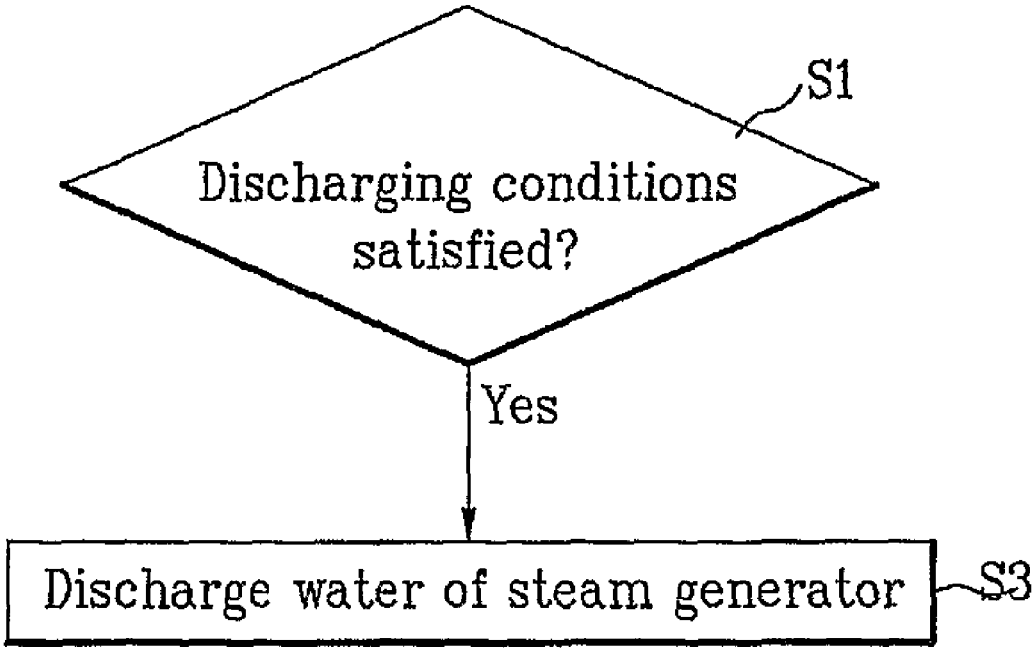

[Fig. 8]
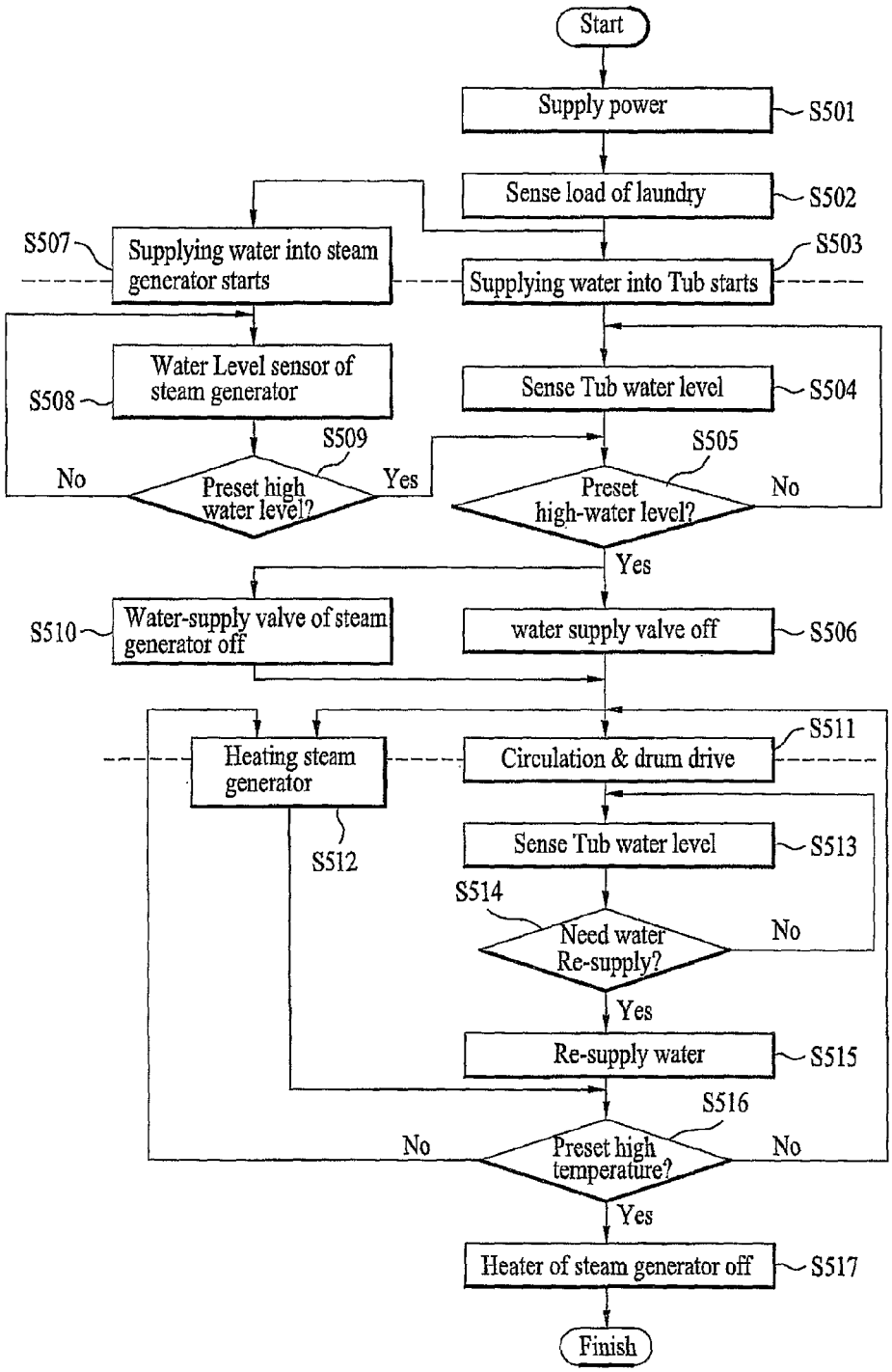

[Fig. 9]
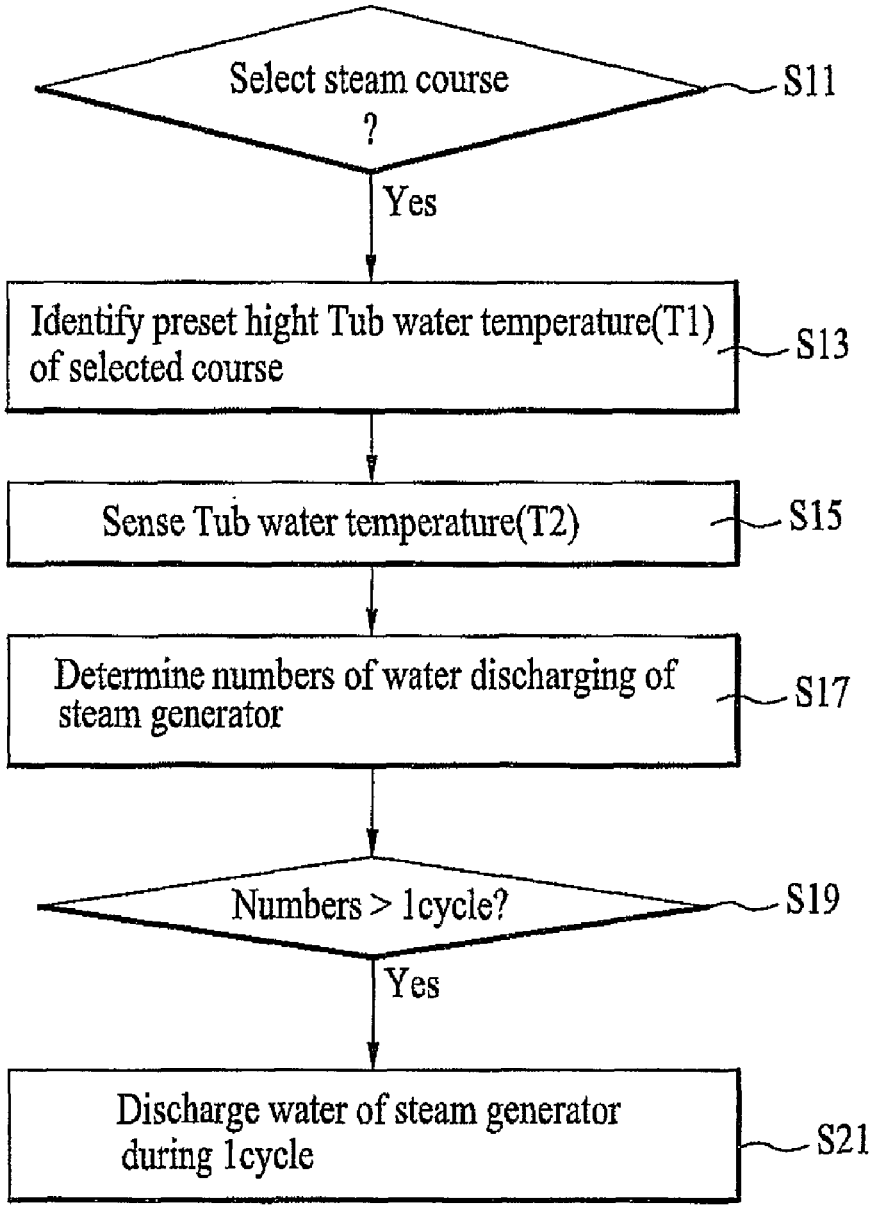

METHOD FOR CONTROLLING WASHING MACHINE

This application claims priority to International application No. PCT/KR2006/000284 filed on Jan. 25, 2006, Korean Application No. 10-2005-0025057 filed on Mar. 25, 2005 and Korean Application No. 10-2006-0002009 filed on Jan. 6, 2006, all of which are incorporated by reference, as if fully set forth herein.

TECHNICAL FIELD

The present invention relates to a method for a controlling a washing machine having a steam generator, and more particularly, to a method for controlling a washing machine so as to remove foreign substances created in the steam generating device.

BACKGROUND ART

In general, a washing machine is classified into a pulsator type washing machine, a drum type washing machine and an agitator type washing machine. The pulsator type washing machine washes laundry using the friction force generated between water current and the laundry by rotating a pulsator, the drum type washing machine washes laundry using drop of the laundry as well as friction force, and the agitator type washing machine washes the laundry using rotatory force by rotating an agitator mounted perpendicularly.

In recent days, it is thus seen that there has been provided a washing machine using steam especially a drum type washing machine which is adapted to use steam for enhancing washing efficiency as well as economizing in water and electric power. Also, wrinkles and bad smell of laundry may be prevented.

Referring to FIGS. 1 and 2, a drum type washing machine, as an example of a washing machine using steam, will be described.

A drum type washing machine includes a cabinet 110 defining an exterior thereof, a tub 120 vertically suspended within the cabinet 110 for holding washing water, a drum 130 rotatably mounted within the tub 120, a driving part 100 for driving the drum 130. A laundry introduction opening 112 is provided in front of the cabinet 110 for loading/unloading laundry, with being in communication with an inside of the drum 130. A door 140 is coupled to the laundry introduction opening 112.

A detergent box 114 and a steam generator 50 is provided in an upper portion of the drum type washing machine. Also, a water supply valve 15: 15*a*, 15*b* and 15*c* is provided in the upper portion of the drum-type washing machine, and is connected with a water pipe (not shown) outside. Commonly, a cold water pipe 113 and a hot water pipe 113*a* are connected each between the detergent box 114 and the water supply valve 15*a* and 15*b*. A water supplying hose 113*b* is connected with a first side of the steam generator 50, and a steam supplying pipe 220 is connected to a second side thereof. The water supplying valve 15*c* allowing the water supplying hose 113*b* connected thereto is generally connected to hot water. Preferably, a first end of the steam supplying pipe is provided with a nozzle 230 for injecting steam into the drum without any difficulties.

As shown in FIGS. 2 and 3, a temperature sensor 150 is provided in the tub 120 for sensing the temperature of washing water within the tub 120 as well as the temperature of a heater for heating washing water supplied into the tub 120.

Also, a circulation channel 170 and a circulation pump 160 may be provided for re-circulating the washing water of the tub 120 into the drum 130.

Referring to FIGS. 1, 4 and 5, a structure of the steam generator will be described.

The steam generator 50 includes a lower housing 51 for defining an exterior thereof as well as space to hold water, an upper housing 52 secured to an upper surface of the lower housing 51, and a heater 320 for heating the water held within the steam generator 50.

An inlet 52*a* connected to a water supplying hose 220 is formed at a first side of the upper housing 52 for drawing water into the steam generator 50, whereas an outlet 52*b* is formed at a second side thereof connected to the steam supplying pipe for supplying generated steam into the drum 120.

The heater 320 is provided in a downside of the lower housing 51, and heats water in a state of being completely sunk in water. For that, a water level sensor 300 is provided within the upper housing 52 for sensing a water level held in the upper housing 52. The water level sensor 300 senses the water level held within the steam generator for maintaining the appropriate amount of the water. That is, once the water level held within the steam generator 50 is lower than a preset value (a preset low water level), the water supplying valve 15*c* is opened for filling up water, whereas once the water level within the steam generator 50 reaches a preset value (a preset high water level), the water supplying valve 15*c* is closed to stop supplying water and the heater 320 is operated to generate steam. Also, a temperature sensor 57 is provided for sensing the temperature of water as well as steam heated by the heater 320. The temperature sensor 57 senses the temperature of steam generated in the steam generator 50. Hence, once the temperature is higher than a preset value, power of the heater 320 is shut off to prevent overheating.

The water level sensor 300 includes a receptacle housing 334 for securing the water level sensor to the steam generator 50, an electrode 331, 332 and 333 each provided in a lower portion of the receptacle housing 334 for sensing the water level within the steam generator 50. The electrode is includes a common electrode 331, a long electrode 332 for sensing a low water lever and a short electrode 333 for sensing a high water level. Each electrode 331, 332 and 333 is provided at a predetermined height from a downside of the lower housing 51 for sensing a water level held within the steam generator 50.

Referring to FIG. 6, a related art method for controlling a conventional drum type washing machine will be described.

In general, there may be included a washing, a rinsing and a dehydrating stroke in a washing process of the drum type washing machine. The washing and rinsing stroke includes a water-supplying stroke. A soaking stroke may be further included in the washing process. Generally, in case that steam is used in a drum type washing machine, steam is injected into a drum in the washing and/or rinsing stroke by means of a predetermined method. Of course, a steam generator is operated for injecting steam. There are various steam injecting methods, and the description thereof will be omitted.

There may be also a hand-operated course for selectively performing a washing, rinsing and dehydrating stroke, and an automatic course for automatically performing each stroke. In case of the automatic course, each condition of the processes, such as a water level and numbers of rinsing, is preset based on a kind of the laundry and a degree of contamination. Also, a steam course may be selected in the automatic and hand-operated course.

As a first embodiment of the related art method for controlling the washing machine, a washing course process selecting a steam stroke, in other words, a steam washing will be described. The following description is only an embodiment, and alternatively other methods for controlling a washing machine are also possible.

First, once power is supplied (S401) and laundry introduction is sensed (S402), water is supplied to a steam generator and a tub S407 and (S403). Hence, the steam generator and the tub determine whether each water level thereof reaches a preset water level by using output values of each water level sensor provided in the steam generator and the tub.

That is, based on the output values sensed by a water level sensor (see FIG. 4) of the steam generator (S408), it is determined whether the water level of the steam generator reaches a preset water level, in other words, a preset high water level (S409). In case that the water level reaches a preset high water level, a water supply valve connected with the steam generator (see FIG. 1) is closed (S410).

Respectively, based on the output values sensed by a water level sensor of the (S404), it is determined whether the water level of the steam generator reaches the preset water level, in other words, a preset high water level (S409). In case that the water level reaches the preset high water level, a water supply valve connected with the steam generator (see FIG. 1) is closed (S410). Commonly, the water supply valve of the steam generator is closed first, and then the water supply valve of the tub is closed.

Once supplying water into the steam generator and the tub is completed, a heater of the steam generator is operated for generating steam (S412). Also, a circulation pump and a drum motor are on/off for loading the laundry uniformly and distributing detergent uniformly (S411). Hence, while supplying steam into a drum a step of determining whether water is re-supplied based on result of water levels each sensed by the steam generator and the tub. Thus, in case re-supplying water is determined as necessary, water is re-supplied (S415).

On the other hand, it is identified if the temperature of washing water in the drum, that is, the temperature of washing water in the tub reaches a preset high water temperature (S416). Hence, once the temperature is identified to reach the preset high water temperature, the heater of the steam generator is stopped. Of course, the heater of the tub is also stopped. After the above process is completed, the next process will start.

DISCLOSURE OF INVENTION

Technical Problem

The related art method for controlling a conventional washing machine, especially, a steam generator has the following problems.

The steam generator according to the related art may have foreign substances, especially, lime components precipitate on its bottom, and a long usage of the steam generator makes the precipitation worse. Commonly, those substances are caused by water drawn into the steam generator and if the water is unclear, that precipitation may get worse. In case that foreign substances precipitate in the steam generator, malfunction of the water level sensor may arise. Thereby, washing efficiency as well as durability of the steam generator may deteriorate.

Furthermore, according to the related art, steam generation performance of the steam generator may deteriorate due to the foreign substances. Thereby, the deterioration of steam generation performance may cause a problem of not utilizing the industrial advantage of a washing machine using steam with a small amount of wash water and low power consumption.

Technical Solution

In a further aspect of the present invention, provided herein is a method for controlling a washing machine which can efficiently preventing foreign substances from precipitating in a steam generator.

To achieve these objects and other advantages and in accordance with the purpose of the invention, as embodied and broadly described herein, a method for controlling a washing machine having a steam generator comprising a step of automatically discharging water of the steam generator outside of the steam generator during the operation of the washing machine. At that time, the water of the steam generator overflows.

Preferably, the water of the steam generator is discharged into a drum of the washing machine at a predetermined time during the operation of the washing machine, and also the water of the steam generator may be selectively discharged by a user.

The step of automatically discharging water of the steam generator outside of the steam generator during the operation of the washing machine is performed while supplying water into the tub in at least one of a soaking, washing and rinsing stroke, and the step of automatically discharging water of a steam generator outside of the steam generator during the operation of the washing machine is performed when supplying water into the tub is completed.

Preferably, the step of automatically discharging water of a steam generator outside of the steam generator during the operation of the washing machine is performed in case that a washing and steam course are additionally selected. At that time, the heater of the steam generator is operated after the step of automatically discharging water of a steam generator outside of the steam generator during the operation of the washing machine is completed.

In another aspect of the present invention, the step of automatically discharging water of a steam generator outside of the steam generator during the operation of the washing machine is performed in case that a washing and steam course are selected. Hence, the step of automatically discharging water of a steam generator outside of the steam generator during the operation of the washing machine is performed based on a sensed water temperature and a preset high water temperature of the tub according to a selected steam course. At that time, the water temperature of the tub is sensed when supplying water into the tub is completed or when a predetermined time passes after starting to supply water into the tub.

Preferably, step of automatically discharging water of a steam generator outside of the steam generator during the operation of the washing machine is performed based on the difference between the preset high water temperature of the tub and the sensed temperature thereof and an escalating water level of the tub, in other words, an escalating water level of the tub per each cycle. Also, the water of the steam generator is discharged only during one cycle.

ADVANTAGEOUS EFFECTS

A method for controlling a washing machine according to the present invention has an advantageous effect that the efficiency of the washing machine is enhanced, because it can prevent foreign substances from precipitating in a steam generator more effectively and conveniently.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a perspective view illustrating a conventional drum type washing machine.

FIGS. 2 and 3 are longitudinally sectional views of FIG. 1.

FIG. 4 is a perspective view illustrating a first embodiment of a steam generator according to the conventional drum type washing machine of FIG. 1.

FIG. 5 is a perspective view illustrating a partially cut-away section of the steam generator in FIG. 4.

FIG. 6 is a flow chart illustrating a method for controlling the related art drum type washing machine.

FIG. 7 is a flow chart illustrating a subject matter of the method for controlling a washing machine according to the present invention.

FIG. 8 is a flow chart illustrating an embodiment embodying FIG. 7.

FIG. 9 is a flow chart illustrating another embodiment embodying FIG. 7.

BEST MODE FOR CARRYING OUT THE INVENTION

Reference will now be made in detail to the preferred embodiments of the present invention, examples of which are illustrated in the accompanying drawings. A washing machine and a steam generator are substantially the same as those of the related art. Thereby, the detailed description will be omitted.

Referring to FIG. 7, a method for controlling a washing machine according to the present invention will be described.

Since foreign substances especially lime components may precipitate in a steam generator as described before, it is required to remove them. For that, a drain may be provided in a downside of the steam generator for discharging foreign substances and the drain is opened for discharging the foreign substances together with water. Hence, water and foreign substances are discharged only to prevent foreign substances from precipitating in the steam generator more efficiently.

However, in the above method, a user or a repairparson should directly open a drain for discharging foreign substances only to cause inconvenience. Thus, according to the present invention, water of a steam generator is automatically discharged outside during the operation of a washing machine for discharging foreign substances simply as well as efficiently.

That is, in the related art steam generator water is only supplied into the steam generator, not discharged outside, and only steam instead water is discharged outside of the steam generator. However, as shown in FIG. 7, according to the present invention water of the steam generator is automatically discharged outside, once predetermined conditions are satisfied. The technical features of the method controlling a washing machine according to the present invention includes a step of determining whether predetermined conditions (hereinafter, "discharging conditions" for discharging water of the steam generator are satisfied (S1), and a step of discharging water of the steam generator outside, once the discharging conditions are satisfied (S3).

There may be various ways of discharging water of the steam generator outside. For example, an auxiliary opening is provided in the steam generator for selectively discharging the water. However, since an outlet 52*b* (see FIG. 4) is provided in the steam generator for discharging steam, preferably the water is discharged outside by means of the outlet.

Referring to FIGS. 3 and 5, a method for discharging water of the steam generator outside by means of a steam outlet will be described.

The steam generator 50 includes an inlet 52*a* for supplying water and an outlet 52*b* for discharging steam. A first end of the steam supplying pipe 220 is connected with the outlet 52 and a second end thereof is connected with a drum 130. Water is not drawn into the steam generator 50 by a water level sensor 300, when a water level is high. However, when water is continuously supplied into the steam generator 50 even at a high water level, the water is discharged into the drum 130 through the outlet 52*b* and the steam supplying pipe 220. Since the outlet 52*b* is provided in an upper portion of the high water level, water of the steam generator 50 overflows through the outlet 52*b*.

In this embodiment, water of the steam generator 50 is discharged through the outlet 52*b* into the drum 130, but alternatively a valve may be provided at the outlet 52*b* not to discharge the water into the drum 130.

On the other hand, the discharging conditions, that is, the conditions in that water of the steam generator is discharged outside may be varied. Preferably, the discharging conditions are selected for a user convenience's sake. For example, an auxiliary discharging button may be provided in an operation display panel for determining whether water of the steam generator is discharged outside. Hence, the user pushes the button to start the step of discharging water of the steam generator outside. That is, the water may be selectively discharged by the user.

Alternatively, it is also preferred but not necessary that the step of discharging water of the steam generator outside is performed without a user's noticing. That is, without a user's selection of the step of discharging water of the steam generator outside, water of the steam generator is automatically discharged at a predetermined time during the operation of a washing machine. For example, once a hand-operated course or an automatic course is selected, a step of discharging water of the steam generator outside is performed for a predetermined time period while performing at least one of a soaking, washing and rinsing stroke. More preferably, the step of discharging water of the steam generator outside is performed together with a step of supplying water into a tub, a part of the soaking, washing and rinsing stroke. Also, even while discharging water of the steam generator, a heater of the steam generator may be operated or not.

On the other hand, a user may alternatively select a steam course when operating a hand-operated course or an automatic course. At that time, preferably the step of discharging water of the steam generator outside is performed. That is, the steam course is selected and the step of discharging water of the steam generator outside is performed, because water of the steam generator does not have to be discharged outside every washing process. Also, since water is supplied into the steam generator in the steam course, it is more convenient to use the water. That is, preferably the step of discharging water of the steam generator outside is performed in case that an automatic course (or a hand-operated course) is selected and a steam course is additionally selected.

Referring to FIG. 8, an embodiment of a method for controlling a washing machine will be described, in case that a steam course is selected.

According to the embodiment of the present invention, the first embodiment of the related art method for controlling a washing machine (see FIG. 6) is applied to the present invention. Thus, for avoiding overlapping of the description, the description described in FIG. 6 already will be omitted.

According to the related art method for controlling a washing machine, supplying water into the steam generator is stopped, once a water level of the steam generator reaches a preset level (a preset high water level). Whereas, according to the present invention, supplying water into the steam generator is continuously performed even when a water level reaches a preset high water level, and supplying water into the steam generator is stopped when a water level of the tub reaches a preset high level.

More specifically, even when water is supplied into the steam generator until the water level reaches the preset high water level, water is continuously supplied to the steam generator without closing the water supplying valve (S508, S508 and S509). Hence, once water is supplied to a preset high water level (S504 and S505), the water supplying valve for the steam generator is closed to stop supplying water.

Referring to FIG. 9, another embodiment of a method for controlling a washing machine according to the present invention will be described.

Another embodiment is similar to the above embodiment, but according to another embodiment of the present invention, water is discharged after heating. Thus, preferably unlike the above embodiment, a heater of a steam generator is operated regardless of a preset high water level of a tub, once a water level of the steam generator reaches a preset high water level.

Generally, once a steam course is selected, washing water of a tub is heated to a preset high water temperature by a heater of a steam generator. A preset high water temperature of a tub is predetermined based on a course selected together with a steam course as well as based on a kind of the laundry and a degree of contamination. Also, the temperature of water supplied into a tub (hereinafter, a supplied water temperature) is preset. The supplied water temperature is reached by means cold water and hot water. For example, in case of a washing machine on sale in the North America, when the laundry is cotton and the degree of contamination is normal, a preset high water temperature is 56° C. and a supplied water temperature is 45~50° C.

That is, it is determined by means of a preset high water temperature and a supplied water temperature whether a step of discharging water of the steam generator is performed. Preferably, the time when the water temperature of the tub is sensed is when supplying water into the tub is completed. In case that supplying water into the tub takes long, the water temperature of the tub is sensed in a predetermined time after supplying water into the tub starts.

On the other hand, in the step of discharging water of the steam generator (S3), water of the steam generator is being discharged outside for a predetermined time (hereinafter, a cycle) after supplying water into the tub starts. A value of increasing water temperature of the tub (hereinafter, a value of increasing water temperature per cycle) (T3) due to the water discharged during the cycle may be evaluated through calculation or an experiment. For example, the range of the increasing water temperature of the tub may be evaluated during one cycle when discharging water by an experiment based on a kind of the product, a kind of the laundry, loading amount and a kind of voltage. It is preferred to use the worst condition, that is, the lowest increasing water temperature per cycle after a plurality of experiments.

Briefly, according to another embodiment of the present invention, it is determined whether the step of discharging water of the steam generator based on the preset high water temperature of the tub T1 described above, the sensed water temperature of the tub T2 and an the increasing water temperature per cycle T3.

Referring to FIG. 9, another embodiment of the present invention will be described in detail.

First, it is determined whether a steam course is selected (S11). Once a steam course is selected, a preset high water temperature of a tub T1 according to the selected steam course is identified (S13). As described above, the water temperature of the tub T2 is sensed right after supplying water into the tub is completed. Preferably, in case that supplying water into the tub takes more than a predetermined time due to some reasons such as much amount of the laundry, the water temperature T2 of the tub is sensed a predetermined time after supplying water into the tub starts.

Hence, comparing the difference the preset high water temperature of the tub T1 and the sensed water temperature of the tub T2, that is, T1−T2=T (hereinafter, temperature difference) and the increasing water temperature per cycle T3, that is, using "temperature difference/increasing water temperature" the number of water discharging cycles of the steam generator is evaluated (S17). It is preferred to perform a step of discharging water of the steam generator, when the value of the water discharging number is more than 1 (S19). Even in that case, it is preferred to discharge water of only one cycle, because discharging water of one cycle has enough efficiency of removing foreign substances.

As described above, once a step of discharging water of the steam generator is performed in case of selecting a steam course, water heated in the steam generator is supplied into a drum. Thereby, the present invention has an advantageous effect of economizing in time as well as energy which is taken for the water temperature of the tub to reach the target water temperature of the tub.

On the other hand, preferably a door is locked for a predetermined time period during the steam course operation for security, even when a user tries to open the door. After the predetermined time period, a door may be unlocked.

The above embodiments illustrate and describe the case of a steam course being selected, which is not defined to that case. That is, the present invention may be applied to the case that a steam course is not selected. In that case, an operation of a heater need not be controlled.

It will be apparent to those skilled in the art that various modifications and variations can be made in the present invention without departing from the spirit or scope of the invention. Thus, it is intended that the present invention cover the modifications and variations of this invention provided they cane within the scope of the appended claims and their equivalents. For example, though the above embodiments illustrate and describe a drum type washing machine for embodying the present invention, the present invention may be applied to a pulsator type washing machine or an agitator type washing machine, furthermore, to a dryer using steam. In that case, it is preferred to discharge water outside by using a drain, not a drum.

INDUSTRIAL APPLICABILITY

Since water of the steam generator according to the present invention is discharged outside of the steam generator together with foreign substances, the present invention has an industrial applicability of efficiently preventing foreign substances from precipitating in the steam generator. Furthermore, not only a user's convenience in using a washing machine but also efficiency of a washing machine may be enhanced, because foreign substances are automatically prevented from precipitating in the steam generator.

The invention claimed is:

1. A method for controlling a laundry machine having a steam generator, the method comprising:

discharging water of the steam generator outside of the steam generator during an operation of the laundry machine and after generating steam by supplying water continuously into the steam generator even when a water level of the steam generator reaches a preset level, wherein the discharge of water is concurrent with the supply of the water to clean the inside of the steam generator, wherein the steam generator is configured to generate steam when the water level of the steam generator reaches the preset level, and wherein the water is discharged after heating by operation of a heater of the steam generator.

2. The method of claim 1, wherein the water of the steam generator is discharged into a tub of the laundry machine.

3. The method of claim 2, wherein the discharging is performed based on a sensed water temperature and a preset high water temperature of the tub.

4. The method of claim 3, wherein the water temperature of the tub is sensed when supplying water into the tub is completed or when a predetermined time passes after starting to supply water into the tub.

5. The method of claim 3, wherein the discharging is performed based on the difference between the preset high water temperature of the tub and the sensed temperature thereof and an increasing water temperature of the tub per cycle.

6. The method of claim 5, wherein the water of the steam generator is discharged in only one cycle.

7. The method of claim 1, wherein the water of the steam generator is discharged at a predetermined time during the operation of the laundry machine.

8. The method of claim 7, wherein the discharging is performed while supplying water into the tub in at least one of a soaking, washing and rinsing stroke.

9. The method of claim 8, wherein the discharging is completed when supplying water into the tub is completed.

10. The method of claim 9, wherein the discharging is performed in a case that a steam course is selected.

11. The method of claim 10, wherein a heater of the steam generator is operated to generate steam after the discharging is completed.

12. The method of claim 8, wherein the discharging is performed in a case that a washing and steam course are selected.

13. The method of claim 7, wherein a door is locked at a predetermined time during the steam course.

14. The method of claim 1, wherein the heater is operated when the water level reaches the preset level.

15. A method for controlling a laundry machine having a steam generator, the method comprising:

determining whether a predetermined condition for discharging water of the steam generator is satisfied, the steam generator being configured to generate steam when a water level of the steam generator reaches a preset level; and discharging water of the steam generator outside of the steam generator during an operation of the laundry machine and after generating steam by supplying water continuously into the steam generator even when the water level reaches a preset level, when the discharging condition is satisfied, wherein the water is discharged after heating by operation of a heater of the steam generator and wherein the discharge of water is concurrent with the supply of the water to clean the inside of the steam generator.

16. The method of claim 15, wherein the discharge condition is satisfied when a user pushes an auxiliary discharging button provided in an operating display panel.

17. The method of claim 15, wherein the discharge condition is satisfied when a user selects a hand operated course or an automatic course.

18. The method of claim 15, wherein the discharge condition is satisfied when a user selects a steam course.

19. The method of claim 15, wherein the discharge condition is satisfied when a user selects a hand operated course or an automatic course and selects a steam course additionally.

20. The method of claim 15, wherein the discharge condition is satisfied when a course is selected by a user.

21. The method of claim 20, wherein the heater is operated when the water level reaches the preset level.

22. The method of claim 20, wherein the discharging is performed based on a sensed water temperature and a preset high water temperature of the tub.

23. The method of claim 22, wherein the water temperature of the tub is sensed when supplying water into the tub is complete or when a predetermined time passes after starting to supply water into the tub.

24. The method of claim 23, further comparing a number of water discharging cycles using a temperature difference between the sensed water temperature and the preset high water temperature, and an increasing water temperature per discharging cycle.

25. The method of claim 24, wherein the water is discharged in a case that the number of water discharging cycles is more than one.

26. The method of claim 15, wherein the water of the steam generator is discharged at a predetermined time during the operation of the laundry machine.

27. The method of claim 26, wherein the discharging is performed while supplying water into the tub in at least one of a soaking, washing and rinsing stroke.

* * * * *